US009349277B2

(12) United States Patent
Yarkoni

(10) Patent No.: US 9,349,277 B2
(45) Date of Patent: May 24, 2016

(54) PERSONAL SECURITY DEVICES AND METHODS

(71) Applicant: Pro4Tech Ltd., Yokneam Ilit (IL)

(72) Inventor: Elazar Yarkoni, Tel-Aviv (IL)

(73) Assignee: Prof4Tech Ltd., Yokneam Ilit (IL)

( * ) Notice: Subject to any disclaimer, the term of this patent is extended or adjusted under 35 U.S.C. 154(b) by 140 days.

(21) Appl. No.: 14/231,851

(22) Filed: Apr. 1, 2014

(65) Prior Publication Data

US 2015/0279199 A1 Oct. 1, 2015

(51) Int. Cl.
*G08B 25/10* (2006.01)
*G08B 25/01* (2006.01)

(52) U.S. Cl.
CPC ..... *G08B 25/10* (2013.01); *G08B 25/016* (2013.01)

(58) Field of Classification Search
CPC ..... G08B 25/016; G08B 21/0261; G08B 21/0461; G08B 25/08; G08B 15/004; G08B 21/02; G08B 21/0225; G08B 21/0247; G08B 21/0269; G08B 21/0277; G08B 21/0283; G08B 21/0288; G08B 21/043; G08B 21/0446; G08B 21/24; G08B 25/007; G08B 25/10; G08B 25/14; G08B 3/10; A43B 3/0005; A43B 7/00; A61B 5/02438; A61B 5/0816; A61B 5/1112; A61B 5/1113; A61B 5/1114; A61B 5/1117; A61B 5/1122; A61B 5/14532; A61B 5/14542; A61B 5/22; A61B 5/4809; A61B 5/4866; A61B 5/4884; A61B 5/6804; A61B 5/6807; A61B 5/681; A61B 5/6833; A61B 5/721; A61B 5/7242; G01S 19/17; G01S 1/06; B63C 9/18; F41H 3/02; G01G 23/3728; G01L 1/04; G01L 1/16; G01L 1/22; G01P 15/00; G06F 19/322; G06F 19/3418; G06Q 50/22; G07C 1/24; H04L 45/308; H04L 63/0492; H04N 1/00493; H04N 21/4126
See application file for complete search history.

(56) References Cited

U.S. PATENT DOCUMENTS 3,990,040 A * 11/1976 Gleitz ..... B60Q 1/52 340/436
5,389,935 A * 2/1995 Drouault ..... G01S 5/04 340/426.15

(Continued)

FOREIGN PATENT DOCUMENTS

DE 102996045875 9/2009
GB 2481605 1/2012

(Continued)

OTHER PUBLICATIONS

RIA Software Co. "Bluetooth Marketing", Bluetooth Marketing Technology Solution, RIA Software Co.™, p. 1-15, 2008.

*Primary Examiner* — Fekadeselassie Girma

(57) ABSTRACT

According to some aspects of the present invention there is provided a device for initiating a distress signal to a mobile communication device. The device may comprise a first and second mechanical element. The mechanical elements receive a pulling force when a distress event occurs, producing a motion of one mechanical element relative to the other mechanical element to irrevocably connect a persistent electrical connection loop between a power source and a wireless communication unit. The wireless communication unit may comprise a processing unit, a non-volatile memory value of a device identification code, and a communication interface. When the wireless communication unit is connected to the power source, a distress signal may be sent to a mobile communication device using the communication interface, and the distress signal may comprise the device identification code.

12 Claims, 10 Drawing Sheets

(56) References Cited

U.S. PATENT DOCUMENTS 5,397,083 A * 3/1995 Thomas ..... B61L 23/047 200/573
5,541,378 A * 7/1996 Niklaus ..... H01H 3/3026 200/400
5,959,834 A * 9/1999 Chang ..... G11B 33/025 361/679.31
6,041,242 A * 3/2000 Coulthard ..... H04W 88/02 455/347
7,552,031 B2 * 6/2009 Vock ..... A43B 3/0005 340/539.13
7,907,931 B2 3/2011 Hartigan et al.
8,249,547 B1 8/2012 Fellner
8,351,895 B2 1/2013 Penix et al.
8,816,839 B1 * 8/2014 Rick ..... F16B 17/00 180/268
2002/0124779 A1 * 9/2002 Perkins ..... E05B 37/20 109/47
2003/0115415 A1 * 6/2003 Want ..... H04M 1/7253 711/115
2004/0002270 A1 * 1/2004 Courtney ..... B63C 9/0005 441/40
2004/0036791 A1 * 2/2004 Voss ..... H04N 1/00283 348/333.07
2005/0168108 A1 * 8/2005 Face ..... H01H 13/7006 310/330
2005/0201301 A1 * 9/2005 Bridgelall ..... H04W 4/203 370/254
2005/0270234 A1 * 12/2005 Wolf ..... A63B 29/021 342/443
2007/0082652 A1 4/2007 Hartigan et al.
2007/0218732 A1 * 9/2007 Honda ..... H04R 1/021 439/188
2008/0191863 A1 * 8/2008 Boling ..... G08B 25/08 340/521
2008/0214142 A1 9/2008 Morin et al.
2008/0258682 A1 * 10/2008 Li ..... B60L 11/185 320/109
2008/0299941 A1 12/2008 Stephens, Jr.
2009/0058611 A1 * 3/2009 Kawamura ..... H04N 7/185 340/10.1
2009/0182913 A1 * 7/2009 Rosenblatt ..... H04M 1/05 710/72
2009/0224908 A1 * 9/2009 Rastegar ..... A43B 7/00 340/539.13
2011/0022411 A1 * 1/2011 Hjelm ..... A61B 5/0015 705/2
2011/0053505 A1 * 3/2011 Fang ..... H04B 17/23 455/41.2
2011/0059720 A1 * 3/2011 Penix ..... G08B 15/004 455/404.2
2011/0085475 A1 * 4/2011 Sinivaara ..... H04L 45/308 370/277
2011/0122019 A1 * 5/2011 Lee ..... G01S 5/0231 342/357.25
2012/0087163 A1 * 4/2012 Morimoto ..... H02M 7/49 363/71
2012/0157037 A1 * 6/2012 Hoffman ..... G08B 25/08 455/404.2
2012/0164968 A1 * 6/2012 Velusamy ..... H04W 4/22 455/404.2
2012/0176237 A1 * 7/2012 Tabe ..... A61B 5/6804 340/539.12
2012/0280902 A1 * 11/2012 Persaud ..... A63F 13/06 345/156
2012/0296453 A1 * 11/2012 Prentice ..... G01S 5/14 700/91
2013/0342989 A1 * 12/2013 Singleton ..... G06F 1/185 361/679.39
2015/0084769 A1 * 3/2015 Messier ..... G08B 21/043 340/539.13
2015/0100983 A1 * 4/2015 Pan ..... H04N 21/4126 725/39
2015/0182113 A1 * 7/2015 Utter, II ..... A61B 5/0004 340/539.12
2015/0182130 A1 * 7/2015 Utter, II ..... A61B 5/0205 600/483

FOREIGN PATENT DOCUMENTS

KR 10-2013-0048887 5/2013
WO WO 2009/145451 12/2009

* cited by examiner

PERSONAL SECURITY DEVICES AND METHODS

BACKGROUND

The present invention, in some embodiments thereof, relates to personal security and, more particularly, but not exclusively, to methods and devices for communicating a distress signal to an emergency assistance provider.

As used herein, the term/phrase emergency assistance provider means a person and/or organization that may provide emergency response assistance to the initiator of a distress signal. For example, an emergency assistance provider may be the police, the fire department, the user's guardian, a personal bodyguard, the user's vehicle driver, a friend of the user, and the like.

As used herein, the term/phrase emergency and/or distress means a situation where the user is in need of assistance. For example, a user has been involved in a vehicle accident and needs assistance. For example, a user has fallen down the stairs and needs assistance. For example, a user has been rendered in an unconscious or semi-conscious state, is in the process of being raped and/or otherwise violated, and needs assistance.

Some solutions for contacting emergency assistance providers when a user is in distress and not able to make a phone call, may be a software application (app) running on a mobile communication device, such as a smartphone, cellular phone, tablet, and the like to create a virtual panic button on the screen of the device. When the user is in distress they may press the screen-based virtual button to alert emergency assistance providers, and the app uses the smartphone's global positioning system (GPS) sensor to transmit the user's location to a predefined contact list. For example, Red Panic Button, DefenCall, 911 Cellular, MyForce, Silent Bodyguard, and the like are products and companies who offer virtual panic button apps for smartphones.

At CES 2013, a smartphone case, termed Coyote Case, with integrated Bluetooth wireless communication, siren, and panic button won the Innovations Design and Engineering Award. When the panic button is pressed on the Coyote Case, a piercing siren deters a would-be attacker while alerting others in the immediate area of your need for help. At the same time, the Coyote Case app automatically sends an emergency short message service (SMS) text alert with your GPS location coordinates to your pre-selected contacts.

The SafetyLink product is a wearable panic button with a GPS sensor. The SafetyLink is an electronic button aimed at keeping the user as safe as possible. The SafetyLink button comes with a smartphone app that allows a guardian to see the location of the user wherever they are, get notifications when other users leave an area, and send alerts out to emergency response providers with access to the app for a specific button. The SafetyLink features sensors that detect shock, like from an automobile accident, allows guardians to locate users via a real time map, and calls responders to help. The SafetyLink may also contact emergency assistance at the touch of a button to save valuable time in case of an emergency. The app, which is free with a SafetyLink button, shows the geographic location of anyone added to the user's app with a SafetyLink button, and allows the guardian to instantly see where friends and family with SafetyLinks are. In addition to the app, owners may log into the Safetylink Cloud to view the Safetylink's location and status from their computer. The SafetyLink may be attached to a key ring, bracelet charm, pendant or necklace, clipped onto a sweater and/or backpack, clipped to clothing, and the like.

SUMMARY

According to an aspect of some embodiments of the present invention there is provided a device for initiating a distress signal to a mobile communication device. The device may comprise a first mechanical element permanently connected to a wireless communication unit. The device may further comprise a second mechanical element permanently connected to a power source, for receiving a pulling force when a distress event occurs. The pulling force may produce a motion of the second mechanical element relative to the first mechanical element to connect a constant electrical loop between a power source and a wireless communication unit. The power source may be in a fixed position relative to the second mechanical element. The wireless communication unit may be in a fixed position relative to the first mechanical element, may comprise a processing unit and may comprise a non-volatile memory value of a device identification code. The device may further comprise a communication interface for sending from the wireless communication unit a distress signal to a mobile communication device, and the distress signal may comprise the device identification code.

Optionally, the power source is in a fixed position relative to the first mechanical element and the wireless communication unit is in a fixed position relative to the second mechanical element.

Optionally, the mobile communication device is any from a list of cellular phone, smart phone, computing tablet, music player, smart watch, personal computer, Bluetooth headset, automobile speakerphone, Bluetooth speaker system, automobile central processing unit, and the like.

Optionally, the device further comprises an inhibiting brake to prevent a disconnection of the constant electrical loop. The inhibiting brake may be any from a list of ratchet, latch, breakable portion of the second mechanical element, and the like.

Optionally, the constant electrical loop between a power source and a wireless communication unit is connected by motion of any component from a list of power source, wireless communication unit, both power source and wireless communication unit, one or more electrical contact between power source and mobile wireless communication unit, and the like.

Optionally, the power source is connected to the wireless communication unit after a distress event occurs.

Optionally, the communication interface is any interface from a list of Bluetooth, wireless local area network, personal local area network, body area network, near field communication, proximity marketing interfaces, and the like.

Optionally, the device further comprises any executable application from a list of mobile communication device, personal computer, web page, cloud server based executable applications, and the like used to configure the device.

According to an aspect of some embodiments of the present invention there is provided a device for initiating a distress signal to a mobile communication device.

The device may comprise a first mechanical element. The device may further comprise a second mechanical element for receiving a pulling force when a distress event occurs, such that the pulling force causes a motion of the second mechanical element relative to the first mechanical element. The second mechanical element motion may connect a constant electrical loop between a power source and a wireless communication unit, and the second mechanical element may be capable of moving in only one direction any from a list of the power source, the electrical circuit, a power source activator, and one or more electrical connection between the power source, the electrical circuit, and the like thereby preventing a disconnection of the electrical loop. The device may further comprise a power source. The device may further comprise a wireless communication unit comprising a processing unit and a non-volatile memory value of a device identification code. The device may further comprise a communication interface for transferring from the wireless communication unit a distress signal to a mobile communication device, and the distress signal may comprise the device identification code.

Optionally, the power source activator is a moveable electrical insulator preventing any of the one or more electrical connection from supplying power from the power supply to the wireless communication unit until the physical force removes the moveable electrical insulator.

Optionally, the power source activator is any from a list of a zinc-air battery seal puncture, a battery electrolyte dispenser, a battery cathode mover, a battery cathode mover, and the like enabling the physical force to supply power from the power supply to the wireless communication unit.

Optionally, the disconnection of the electrical loop is prevented by an electronic component from a list of electromechanical relay, field effect transistor, and the like which preserve a power connection to the wireless communication unit.

Optionally, the device is a wearable device located on an item of clothing of a user in distress, and the physical force is activated by a violation of the clothing.

Optionally, the device is a wearable device located on an ornament of a user in distress, and the physical force is activated by a violation of the ornament.

According to an aspect of some embodiments of the present invention there is provided a method for initiating a distress signal to a mobile communication device. The method comprises an action of receiving a pulling force on a mechanical element, the pulling force causing a motion of the mechanical element to partially exit the device. The method further comprises an action of activating power to a wireless communication unit by motion of the mechanical element. The method further comprises an action of sending a distress signal by said wireless communication unit, said distress signal received by a mobile communication device using a communication interface.

Optionally, the mobile communication device is any from a list of cellular phone, smart phone, computing tablet, music player, smart watch, personal computer, Bluetooth headset, automobile speakerphone, Bluetooth speaker system, automobile central processing unit, and the like.

Optionally, the communication interface is any from a list of Bluetooth, wireless local area network, personal local area network, near field communication, body area network, proximity marketing interfaces, and the like.

Optionally, the distress signal is communicated to an installed application that transfers the distress signal to similar installed applications on other mobile communication devices.

Optionally, the power activation is latched and further force on the mechanical element does not cancel the power activation.

Optionally, the pulling force must be greater than a minimum threshold force value to prevent false alarms.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention may involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input devices such as a keyboard or mouse are optionally provided as well.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION

Figure 1A:
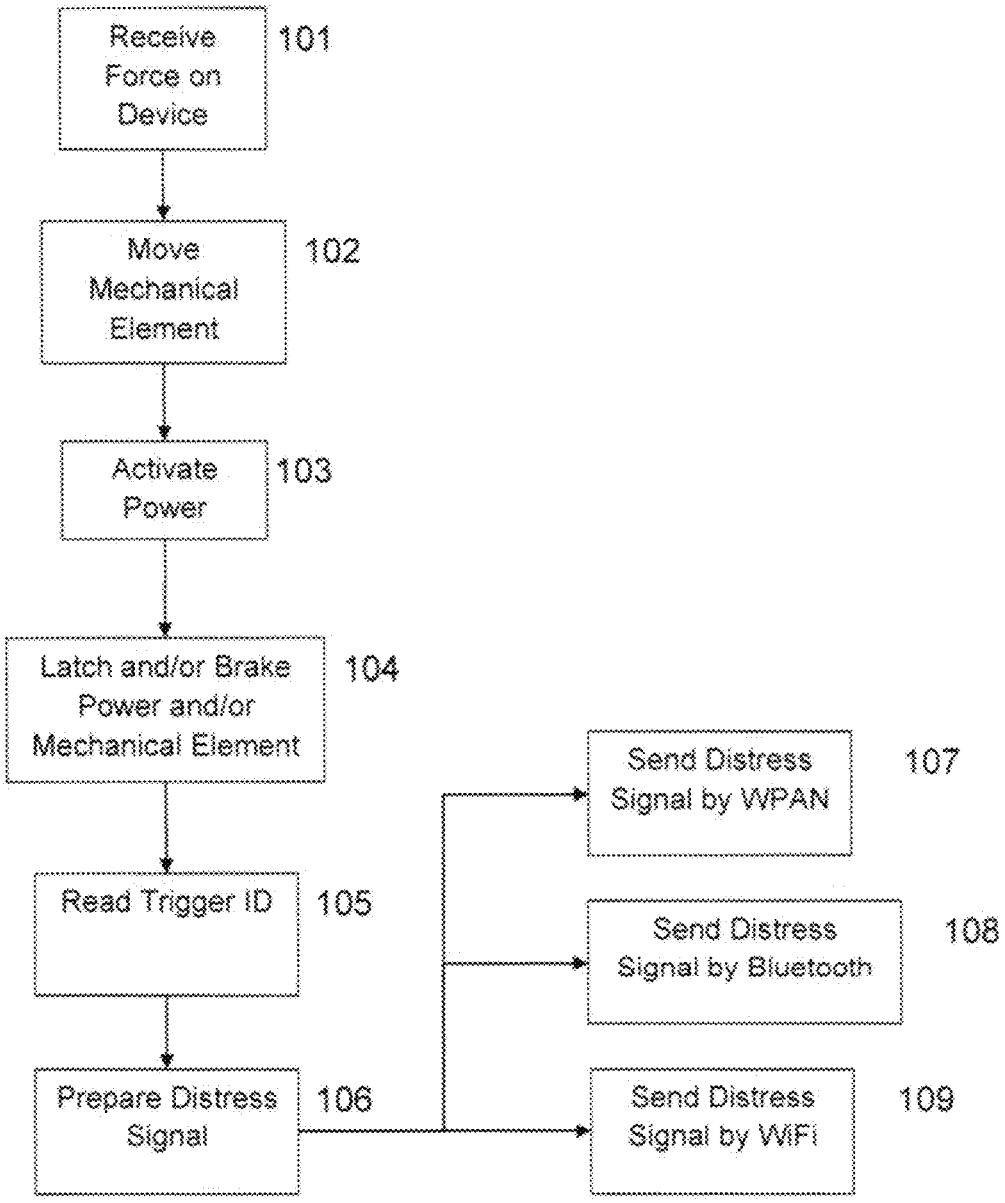
FIG. 1A is a flowchart of a method for sending a distress signal, according to some embodiments of the invention.

The present invention, in some embodiments thereof, relates to personal security and, more particularly, but not exclusively, to methods and devices for communicating a distress signal to an emergency assistance provider.

Current solutions for emergency assistance provider contact may be through using a mobile communication device to make a voice call to a phone number, such as a 911 number. In many cases, this might not be possible as the user needing emergency assistance may be incapacitated or otherwise unable to make a phone call. As many parents and/or caregivers, referred to herein as a guardian, of adolescents and/or teenagers, referred to herein as a user, may be under increasing pressure to allow their charge to engage in unsupervised activities, such as going out with friends at night, there may be significant motivation on the part of the user and/or guardian to have additional personal security for the user.

Some solutions to this issue are provided in the form of accessory devices to mobile communication devices that may use a panic button to contact an emergency assistance provider. These solutions require that the user has access to the panic button, which might be in their bag or jacket, and also are conscious enough to identify the emergency situation and perform the required distress signal initiating action. These severely limit the utility of these solutions. Other solutions use rings, necklaces, pendants, bracelets and other wearable ornaments to implement the emergency situation, but these solutions do not address the issue of semi-conscious or unconscious users, and a panic button may be disabled prior to activating an emergency call for help. Most of these methods also require that the user's mobile communication device is within range and powered on. Many of these methods use wireless interfaces for transfer of an emergency event signal from the panic button to the mobile communication device, and from there to the emergency assistance provider. When the wireless environment is not functional due to electromagnetic interference and/or absence of cellular network data and/or voice coverage these solutions may not work.

Embodiments of the invention described herein provides solutions to the issues of existing products, by using a distress signal trigger device, which when activated by a single hand movement such as pulling, wirelessly sends a distress signal to one or more mobile communication devices in its vicinity. The mobile communication devices, in turn, initiate a distress event and relay the distress signal on to emergency assistance providers, optionally according to records stored in a central server and/or the mobile communication devices. Subsequent to activation, the distress signal may not be cancelled until the safety, health and well being of the user have been confirmed by an emergency assistance provider. As used herein, the term/phrase distress signal trigger devices and/or trigger means a wearable emergency response initiating accessory for sending a distress signal to one or more nearby mobile communication devices. For example, the activation of the distress signal trigger devices is similar to activation of a road hazard flare, a single pulling action initiates a distress signal transmission session which optionally cannot be cancelled and/or revoked, and during which a distress signal is broadcasted from a distress signal trigger devices until the power source is depleted.

According to some embodiments of the present invention there are provided transmission devices, also referred to herein as a distress signal trigger devices, able to transmit a distress signal to a mobile communication device. The distress signal is automatically sent to the mobile communication device when a mechanical element permanently connected to a power source is operated by a single hand gesture, such as a pulling gesture. The pulling gesture moves the power source connected mechanical element relative to a mechanical element permanently connected to a wireless communication unit, and brings, optionally irreversibly, the power source, such as a battery, into electronic contact with the wireless communication unit. The wireless communication unit is configured to automatically transmit a distress signal to one or more mobile communication devices therearound when a power source is mechanically and/or electrically connected by pulling the trigger. These distress signal trigger devices may be operated intentionally when the user feels threatened and/or unintentionally by the assailant. These distress signal trigger devices do not require intentional activation by the user and may be activated without the user performing manual contact with any mobile communication device which may be in a bag or jacket. For example, when an assailant attacks a user, renders them unconscious, and then attempts to assault the user by removing their clothing, a distress signal trigger device attached to the clasp of a pant's belt may be pulled and/or activated.

The distress signal trigger devices may be incorporated into a wearable ornament and/or a clothing article. For example, the distress signal trigger devices may be an integral part of a necklace clasp, bracelet clasp, pants zipper, pants button, blouse button, belt buckle, purse latch, and/or the like. For example, a distress signal trigger device setup procedure may include incorporating the distress signal trigger device into the hook of a brassiere, such that if the brassiere is opened by force, the distress signal is activated by the power source connected mechanical element being pulled away from the wireless communication unit connected mechanical element.

The distress signal trigger device may be part of a system that incorporates a client module, such as a mobile communication device software application. The client module may be installed in a mobile communication device, such as a smartphone, receives a distress signal and triggers one or more predefined distress actions, such as telephone calls and/or text messages. The distress signal trigger devices may have one or more mechanical elements which permanently secure a power source into electronic contact with a wireless communication unit. This may prevent unwanted deactivation of the emergency transmission session and may allow the activation to be initiated when an irregular pulling force is applied on the distress signal trigger devices. For example, a single pulling action activates the distress signal.

Optionally, an emergency transmission application, referred to herein as a client module, is installed on one or more mobile communication devices. The distress signal trigger devices identification number (trigger ID), such as a media access control address, may be registered as active and the distress actions are defined on an emergency response server and/or the mobile communication device. When the power source connected mechanical element of the distress signal trigger devices is pulled, a wireless signal may be sent to a mobile communication device within wireless range. When a mobile communication device within range has the installed client module, the client module receives a trigger ID and the location from the mobile communication device GPS sensor and trigger ID are transmitted to an emergency response server. As used herein, the term/phrase server means an emergency response server capable of receiving a relayed distress signal from the distress signal trigger devices and notifying one or more emergency response providers of the distress event. When the client module has been made aware of the distress actions, either by previous setup and/or by response from the emergency server, the client module may attempt to execute these distress actions, for example the client module may place a telephone call to predefined numbers and play a predefined recording, sends predefined text and/or data messages, and/or follows other predefined instructions, such as contacting an attorney and/or press agent to publish a document into the public domain. Optionally, the distress signal encodes instructions to present an alerting sound by the receiving mobile communication devices therearound.

The present invention, in some embodiments thereof, relates to personal security and, more particularly, but not exclusively, to methods and devices to provide a user with a distress assembly that sends a distress signal when activated by a single hand action, for example a pulling action. The single hand action may be of a user wearing the distress assembly or of an attacker ripping an article to which the distress assembly is attached. The device, referred to herein as a distress signal trigger devices comprises a power source connected mechanical element, that when a single pulling force is applied to this power source connected mechanical element, activates a wireless communication unit by connecting a power source to a wireless communication unit. As used herein, a pulling action is an action sending one end of a distress signal trigger devices away from an opposing end thereof. The distress signal trigger devices may further comprise one or more latches and/or brake elements which prevent the disconnection of the power source from the wireless communication unit. The wireless communication unit sends one or more distress signals such as one or more wireless emergency event messages to one or more nearby mobile communication devices, such as cellular and/or smart phones. The one or more nearby mobile communication devices in turn may relay this message to an emergency server, make a phone call to an emergency assistance provider, and/or send a text message to an emergency assistance provider. The distress signal(s) are optionally, received by the mobile communication devices with or without Bluetooth pairing.

Optionally, the wireless communication unit sends a distress signal by wireless communication with one or more nearby mobile communication devices, using a wireless personal area network (WPAN) interfaces, such as Bluetooth™ interface or a Zigbee™ interface, and/or wireless local area network (WLAN) interfaces, such as Wi-Fi™ without prior pairing with the mobile communication device(s). Optionally, the wireless communication unit sends a distress signal using a near field communication interface, radio frequency identification interface, ultra-wideband communications interface, wireless personal area network, wireless universal serial bus, z-wave interface, body area network, and the like. These interfaces may allow the initiation of an emergency transmission session without having to go through a pairing process.

Optionally, when a mobile communication device within range does not have the installed client module, the mobile communication devices receive a wireless message with the emergency event details. For example, the trigger ID, location, time and user name are transmitted to nearby mobile communication devices using a wireless interface.

Optionally, the power source and wireless communication unit are connected to the other's mechanical element, such that the wireless communication unit is pulled to electrically connect with the power source. Optionally, both the power source and wireless communication unit are in fixed locations, and a mechanical element moves electrical connectors so as to electronically connect the power source and wireless communication unit. Optionally, the mechanical element moves an insulator preventing the electrical connection and thereby enables the electrical connection. Optionally, the mechanical element electrochemically activates a power source, such as puncturing the seal of a zinc-air battery.

Optionally, the distress signal trigger device is placed to protect the property of the user. For example, the distress signal trigger device is placed on the door handle of room so that an opening of the door initiates a distress signal. For example, the distress signal trigger device is placed on handle of a window so that an opening of the window initiates a distress signal. For example, the distress signal trigger device is placed on handle of a drawer so that an opening of the drawer initiates a distress signal. Optionally, the initiation of a distress signal for the protection of property is done without a mobile communication device in the vicinity, and the distress signal is received by a personal computer in the vicinity of the protected property. For example, the distress signal trigger device initiates a distress signal received by a personal computer, the transfers the signal to an emergency response server for further actions.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention may be a system, an apparatus, a device, a process and/or a method.

Aspects of the present invention are described herein with reference to flowchart illustrations and/or block diagrams of methods, apparatus, and systems according to embodiments of the invention. It will be understood that each block of the flowchart illustrations and/or block diagrams, and combinations of blocks in the flowchart illustrations and/or block diagrams, can be implemented by computer readable program instructions.

The flowchart and block diagrams in the Figures illustrate the architecture, functionality, and operation of possible implementations of systems, methods, and devices according to various embodiments of the present invention. In this regard, each block in the flowchart or block diagrams may represent a module, segment, or portion of instructions, which comprises one or more actions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

According to some embodiments of the present invention there is provided a distress signal trigger device for personal security applications. The distress signal trigger device may be an ultra-small wearable accessory, such as a cellular phone and/or smartphone accessory, which may act as an emergency distress signal trigger device by activating a user's phone to call, send text and/or voice messages and user location to a predefined contact list. The ultra-small size of the device may be 6 mm long, 8 mm long, 10 mm long, or 12 mm long, long referring to the largest dimension of the device. The other dimensions of the distress signal trigger device may be smaller that the long dimension.

Figure 4A:
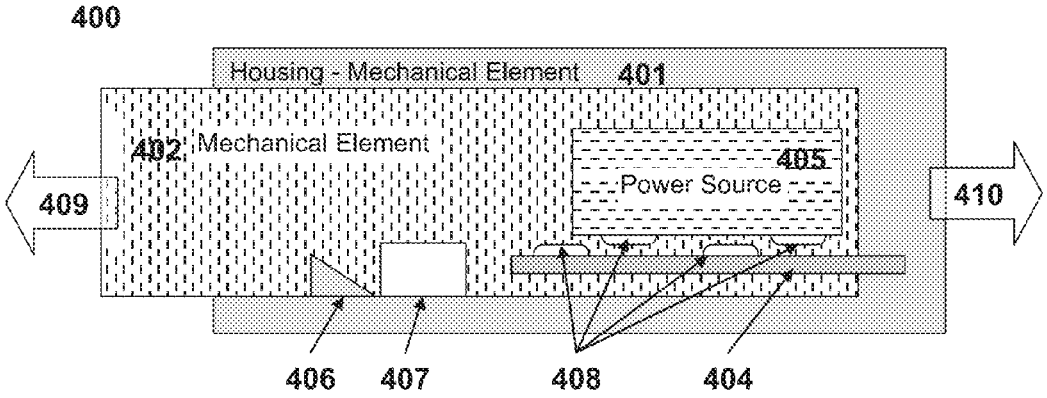
FIG. 4A is a schematic illustration of distress signal trigger devices shown in cross section, according to some embodiments of the invention.

Reference is now made to FIG. 4A, which is a schematic illustration of distress signal trigger devices shown in cross section, according to some embodiments of the invention. The distress signal trigger device 400 may be comprised of a wireless communication unit connected mechanical element 401 and a power source connected mechanical element 402. The device may contain a power source 405 connected to the power source connected mechanical element 402 and a wireless communication unit 404 connected to the other mechanical element 401, where each of these may contain multiple electronic contacts 408. The power source connected mechanical element 402 may have a latch and/or brake 406. One end of the device 409 may be attached to one side of an opening of an article of clothing and the other side of the device 410 to the other side of the opening, such that the opening of the article of clothing is normally closed. The distress signal trigger devices 400 may be activated by a single hand action, such as pulling action 409 on a tab and/or pulling action on a cord, which moves the power source connected mechanical element 402 relative to the wireless communication unit connected mechanical element 401, and may connects the power source 405 to a wireless communication unit 404. When the position of the power source connected mechanical element 402 changes relative to the wireless communication unit connected mechanical element 401 a physical connection is established between electrical contacts 408 for the positive and negative voltage terminals of the power source 405 to the wireless communication unit 404. The pulling may be performed by a single action of applying force on the power source connected mechanical element 409 and a counterforce on the device 410. The power source connected mechanical element may perform a one way activation of an emergency event, and may not be cancelled until the safety and well being of the user is confirmed by the emergency assistance provider. The phrase one way activation may mean that the electrical connection loop is connected permanently, constantly, irrevocable, and the like, such that the electrical connection cannot be disconnected by further physical force and the wireless communication unit will continue to send a distress signal until the power source is depleted and/or destroyed by brute force such as, destruction of the electronic circuit by physical force, fire, heat, chemicals, and the like. This one way activation is performed using a latching and/or breaking mechanism where a protrusion and/or latch 406 may enter a recess 407 so that the power source connected mechanical element may not return to the un-activated position. The wireless communication unit, once activated, broadcasts one or more wireless messages containing the trigger ID to one or more nearby mobile communication devices, mobile phones, and/or smartphones.

According to some embodiments of the present invention there is provided method for contacting emergency response provider in the case of a personal security violation. A distress signal trigger device may be configured for use by storing the desired distress actions associated with the trigger ID, and physically attaching the distress signal trigger device to the clothing and/or ornaments of a user. The first time a distress signal trigger device is used, the user's mobile communication device may be configured with a client module that stores the trigger ID, stores the distress action list, and receives the distress signal from the distress signal trigger devices when needed. Optionally, the trigger ID and distress action list are stored on an emergency response server. When the distress signal trigger device is activated, the mobile communication device may attempt to execute the distress actions directly, through an emergency response server, and/or through other mobile communication devices it may communicate with. This may continue until an acknowledgement has been received by the mobile communication device that the emergency response provider has been activated and/or the distress event has terminated.

Figure 1B:
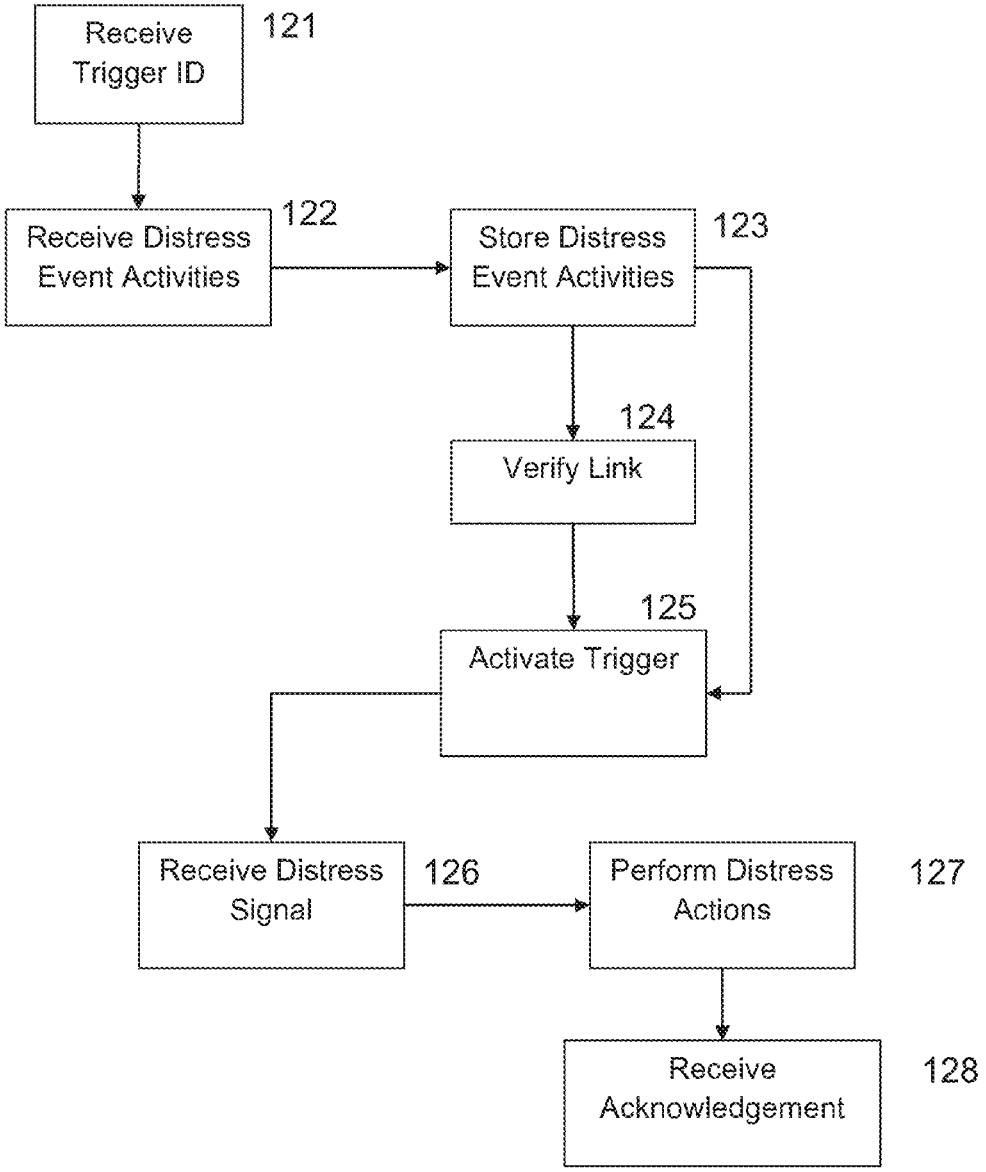
FIG. 1B is a flowchart of a method for configuring and activating a distress signal trigger device, according to some embodiments of the invention.

Reference is now made to FIG. 1B, which is a flowchart of a method for configuring and activating a distress signal trigger devices, according to some embodiments of the invention. A trigger ID 121 and/or distress event activity list 122 may be stored 123 on the mobile communication device and/or an emergency response server. Optionally, the link between the distress signal trigger device, mobile communication device, and server is verified 124 using a test button and/or test activation mechanical element separate from the distress event activation power source connected mechanical element. When the distress signal trigger device is activated 125, the mobile communication device and/or emergency response server may receive a distress signal 126 and perform the stored distress activities 127, until an acknowledgement is received 128 to confirm that the performance of the distress activities is no longer required.

Reference is now made to FIG. 1A, which is a flowchart of a method for sending a distress signal, according to some embodiments of the invention. The activation of an emergency and/or panic event may be initiated by a single pulling force on the distress signal trigger device 101, which may cause a motion of the power source connected mechanical element 102. This motion establishes contact between the power source and the wireless communication unit to activate power to the wireless communication unit 103, and subsequently the power source connected mechanical element is latched and/or braked in place 104. The wireless communication unit reads the trigger ID 105 and prepares a distress signal 106. This distress signal may be sent to nearby mobile communication devices wirelessly using wireless personal area networks 107, Bluetooth 108, and/or wireless local area network (WiFi) 109.

Figure 1C:
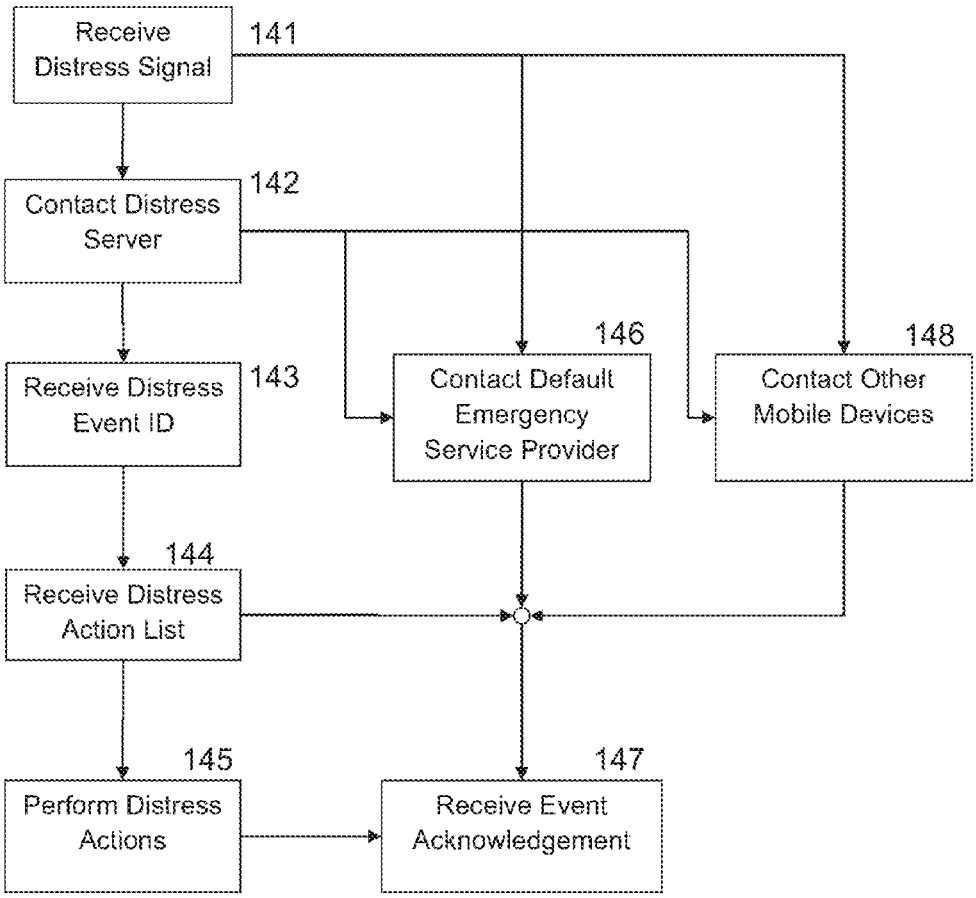
FIG. 1C is a flowchart of a method for responding to a distress signal, according to some embodiments of the invention.

Reference is now made to FIG. 1C, which is a flowchart of a method for responding to a distress signal, according to some embodiments of the invention. The nearby mobile communication devices and/or phones may receive the distress signal from the distress signal trigger device 141, and may relay the distress signal to a distress server 142, a default emergency response provider 146, and/or other mobile communication devices s 148. The trigger ID along with a location and time stamp may be transferred to the multiple emergency assistance providers listed in the distress action list, such as an emergency server, a law enforcement representative, a guardian, and the like. The message may be transferred using a text message, data link, voice message, and the like. When the mobile communication device was successful in contacting the distress server and initiating a distress event, the distress server may send a distress event ID back to the mobile communication device 143 so that the event may be logged and tracked. Additionally, the server may send a list of distress actions 144 to inform and/or update the mobile communication device. The mobile communication device may then perform these distress actions 145 until an event acknowledgement is received 147 to confirm that the emergency assistance provider has received the distress event and assisted the user.

Optionally, the distress signal trigger device broadcasts until the power source is depleted one or more wireless distress signals, to one or more mobile communication devices using one or more wireless interfaces. For example, once triggered, the distress signal trigger device will broadcast a distress signal using Bluetooth without pairing, proximity marketing, near field communications, wireless local area network, and the like. The distress signal may contain the trigger ID, instructions for emergency responders, and the like, so as to activate an emergency response.

Optionally, the mobile communication device receives a distress signal and performs a list of predefined actions. For example, a mobile communication device is preconfigured with a list of one or more emergency response actions, receives a distress signal and performs the actions of calling a law enforcement phone number, sending a text message to a caretaker, and sending an email to a friend. For example, the list of actions is continuously attempted until each action is confirmed as having been acknowledged either by the recipient, an emergency response server, a network entity, and the like.

Optionally, the mobile communication device receives a distress signal and relays the distress signal to a second mobile communication device. Optionally, the second mobile communication device performs the list of actions as described herein. Optionally, the second mobile communication device relays the distress signal to a third mobile communication device, and so on until an emergence response is acknowledged. For example, the mobile communication device does not have cellular access, transfers the distress message using a wireless interface to a friend's mobile communication device which is preconfigured with the list of emergency response actions, and the friend's mobile communication device performs the list of emergency response actions. For example, the mobile communication device does not have cellular access, transfers the distress message using a wireless interface to a stranger's mobile communication device which is not preconfigured with the list of emergency response actions, the stranger's mobile communication device receiving a text message to send the trigger ID as a text message to the emergency response server, and the stranger performs the action.

Optionally, the mobile communication device receives a distress signal and relays the distress signal to emergency response server who in term performs a list of predefined actions. The actions will continue to be performed until an acknowledgement is received by the emergency response provider for each action on the list or until the distress event is closed.

For example, an analogy of the method of relaying the distress signal is a domino show, where one device will repeatedly try to activate the next device, where a device may be the trigger device, a mobile device, a personal computer, a server, an emergency response server, and the like until the action list is activated. The action list may be performed until an acknowledgement is received that the emergency responders have closed the distress event. Thus, priority is given to the response to the distress event. When a distress signal is mistakenly activated, the user may log into the emergency response server and report a false activation thereby closing the distress event.

Optionally, the mobile communication device is a cellular phone, a smart phone, a tablet, a personal computer, a smart watch, a Bluetooth headset, an automobile speakerphone, a Bluetooth speaker system, an automobile central processing unit, and the like. In this patent application the term mobile communication device and/or smartphone may refer to any of the devices that may accept a distress signal from a distress signal trigger device.

The distress signal trigger device may attempt to broadcast a distress signal to any mobile communication device in range of the distress signal trigger device. The broadcast may be in the form of a text message, a voice message, a data message, and the like. The broadcast may be an audible or visual broadcast. The mobile communication device may attempt multiple broadcasts with multiple means to multiple receivers. For example, when the user's mobile communication device does not have cellular coverage, an alternative device transfers the distress signal to an emergency response provider. For example, when the user's mobile communication device does not have data cellular coverage, an alternative device transfers the distress signal to an emergency response provider. For example, when the user's mobile communication device is turned off, an alternative device transfers the distress signal to an emergency response provider.

Optionally, Bluetooth™ pairing is not required between the distress signal trigger device and the mobile communication device. The distress signal trigger device may transmit wireless advertisement data, such as a beacon, and the client module stores the trigger ID and registers the trigger ID in a database on the emergency response server. Traditional pairing process involves communication of a two-way authentication, and data may be exchanged in both directions, such as password, physical address, and the like. For example, the communication between the distress signal trigger device and the mobile communication device is a one-way communication using Bluetooth™ without requiring previous pairing between the trigger and communication devices. For example, the distress signal trigger device may use a Bluetooth friendly name registered on the mobile communication device and/or client module. For example, the distress signal trigger device may use a Bluetooth pairing protocol to send mobile communication device the trigger ID and the initiate a distress event.

Optionally, the distress signal trigger device transmits a second Bluetooth communication with additional details on the distress event. For example, the distress signal trigger device transmits a second Bluetooth communication with details on the trigger ID, the number of activations, whether the trigger has been damaged, the time of first activation, the time of a previous activation, and the like.

Optionally, the distress signal trigger device broadcasts a distress signal to other mobile communication devices with the installed client module within wireless communication range. For example, a friend and/or acquaintance may have the installed client module intentionally on their mobile communication device to provide support in case of a distress event.

Optionally, the mobile communication device with installed client module is aware of the distress event list associated with a distress signal trigger device. For example, the emergency response server may receive a command to transfer the distress event list associated with a distress signal trigger device to the mobile communication device of the friend and/or acquaintance.

Optionally, a casual mobile communication device does not have the installed client module, and onscreen messages are sent by the mobile communication device of the user when a distress event occurs to prompt the user of the casual mobile communication device to assist the user. For example, a text message is sent to the casual mobile communication device to call the police using proximity marketing and/or Bluetooth advertisement. For example, a text message is sent to the casual mobile communication device to call the police using an application such as Waze, Google+ and/or Google Maps.

Optionally, the GPS sensor of the mobile communication device is activated to send the distress event location along with the trigger ID in the distress signal.

Optionally, the mobile communication device emits light and/or sound in a distress signal pattern. For example, an international Morse code distress signal is sent form the mobile communication device using sound and/or light.

Optionally, the emergency assistance provider and/or guardian of the user configure an emergency response server and/or a mobile communication device with the distress action list.

Optionally, the user configures the emergency response server and/or mobile communication device with the distress action list.

Optionally, the mobile communication device client module is installed on the mobile communication device of a friend and/or acquaintance.

Optionally, the mobile communication device client module opens a wireless communication interface intermittently to check the broadcast of a trigger ID, for example to save power consumption of the mobile communication device.

Optionally, the mobile communication device client module operates as an operating system service. For example, executing in the background as part of the operating system such that a restart of the mobile communication device will also restart the client module application.

Optionally, the distress action list is configured on a computer using dedicated software, a web page, and/or an application running on a cloud server.

Optionally, the user calls cancels a distress event. For example, in case of accidental activation, the user enters a password and/or code onto the mobile communication device to deactivate the distress event.

Optionally, the emergency assistance provider cancels a distress event. For example, after a user has received emergency assistance the provider and/or guardian closes the distress event.

Optionally, a distress signal is transferred from one mobile communication device to another until the distress event is cancelled.

Figure 2A:
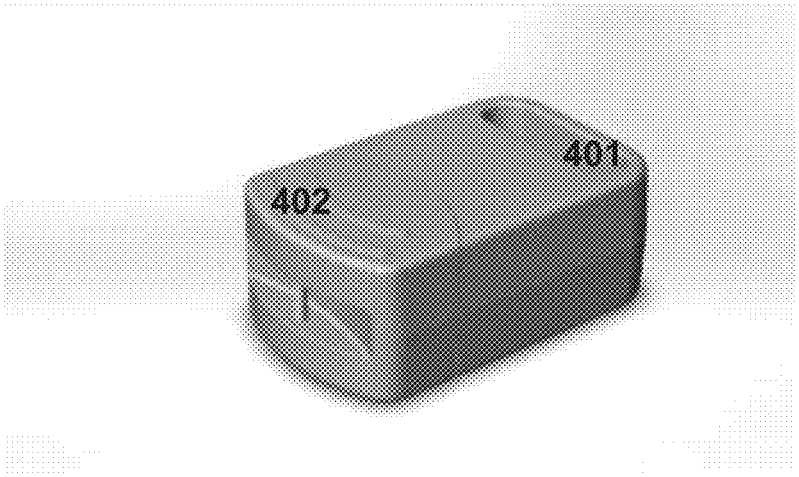
FIG. 2A is a schematic illustration of distress signal trigger devices in the closed configuration, according to some embodiments of the invention.
Figure 2B:
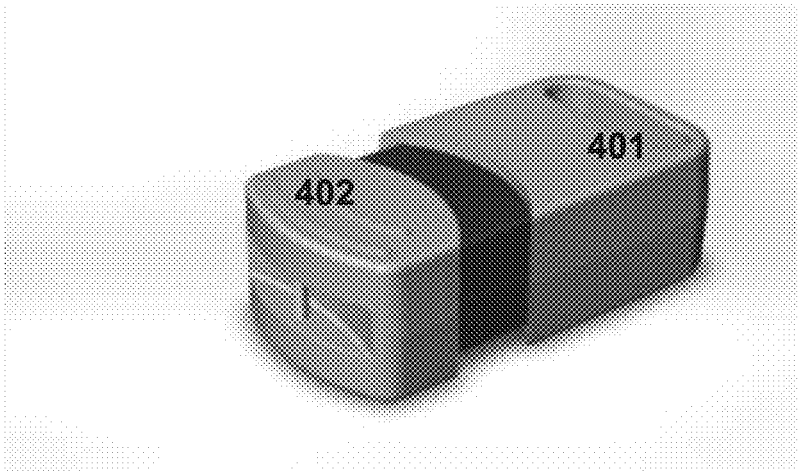
FIG. 2B is a schematic illustration of distress signal trigger devices in the activated configuration, according to some embodiments of the invention.
Figure 3:
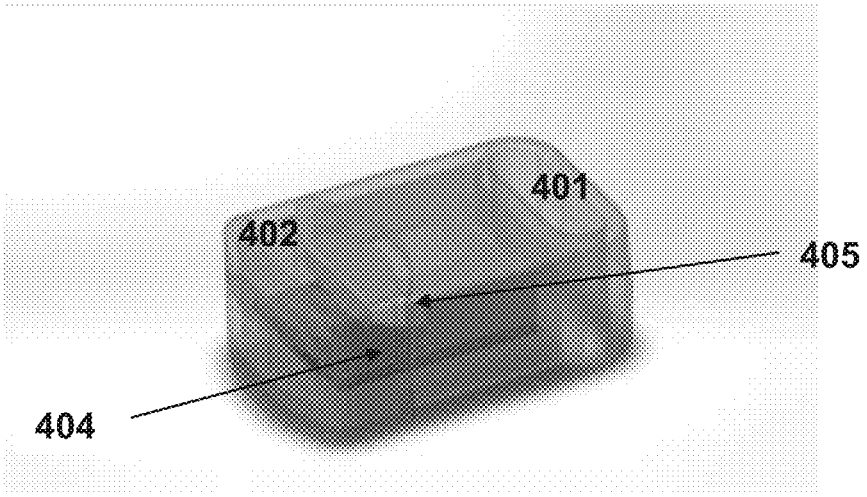
FIG. 3 is a schematic illustration of distress signal trigger devices shown in transparency, according to some embodiments of the invention.

Reference is now made to FIG. 2A, which is a schematic illustration of distress signal trigger devices in the closed configuration, according to some embodiments of the invention. A distress signal trigger device wireless communication unit connected mechanical element 401 is shown with the power source connected mechanical element 402 in the closed and un-activated position. Reference is now made to FIG. 2B, which is a schematic illustration of a distress signal trigger devices in the activated configuration, according to some embodiments of the invention. A distress signal trigger devices wireless communication unit connected mechanical element 401 is shown with the power source connected mechanical element 402 in the open and activated position. Reference is now made to FIG. 3, which is a schematic illustration of distress signal trigger devices shown in transparency, according to some embodiments of the invention. The relative positions of the device wireless communication unit connected mechanical element 401, the power source connected mechanical element 402, the power source 405 and the wireless communication unit 404 are shown.

Figure 4B:
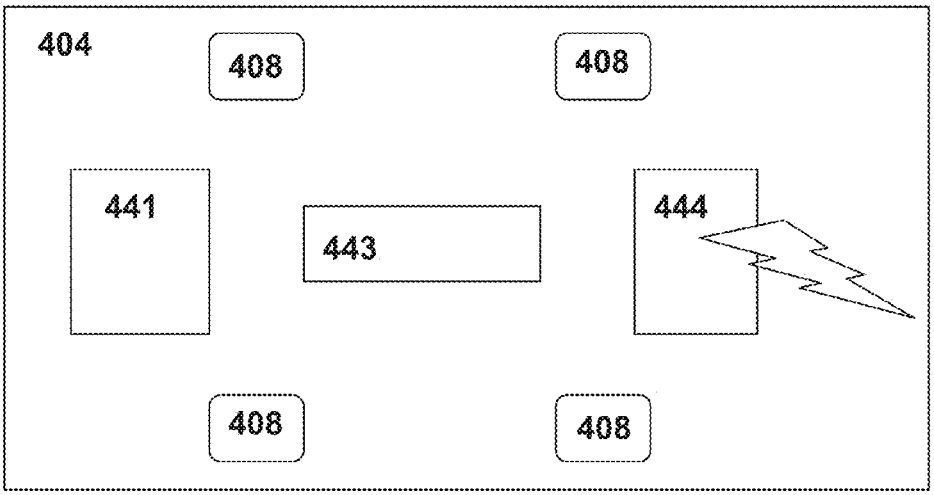
FIG. 4B is a schematic illustration of wireless communication unit, according to some embodiments of the invention.

Reference is now made to FIG. 4B, which is a schematic illustration of wireless communication unit, according to some embodiments of the invention. The wireless communication unit 404 may comprise one or more processing units 441, one or more non-volatile memory values with a trigger identification number value 443, one or more wireless communication interfaces 444, and one or more electronic contacts 408 to connect a power source to the wireless communication unit. When a power source is connected to the wireless communication unit, the processor retrieves the trigger ID memory value, and sends this values in a distress signal broadcasted wirelessly using the wireless communication interface 444.

Figure 4C:
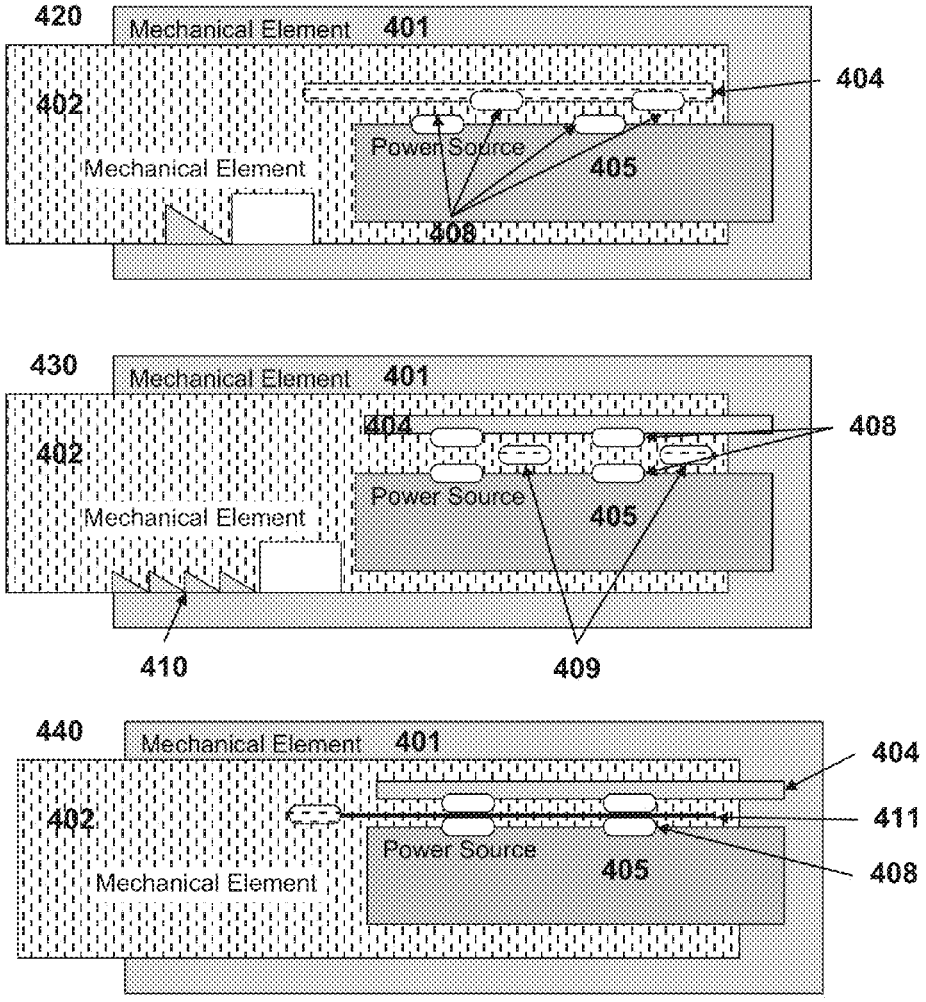
FIG. 4C is a schematic illustration of alternative devices to permanently connect a power supply and a wireless communication unit, according to some embodiments of the invention.

Reference is now made to FIG. 4C, which is a schematic illustration of alternative devices to permanently connect a power supply and a wireless communication unit, according to some embodiments of the invention. Alternative 420 illustrates the wireless communication unit 404 and power source 405 connected to the opposite mechanical units 402 and 401 as illustrated in FIG. 4A. Alternative 420 shows the same latch mechanism as FIG. 4A to enable one-way activation and/or prevent a disconnection of the electrical connection loop. Alternative 430 illustrates the wireless communication unit 404 and power source 405 connected to the same mechanical unit 401 and the one-way activation of the electrical connection loop may be performed by the motion of the other mechanical element 402 moving one or more electrodes 409 to electrically connect between the wireless communication unit 404 and the power source 405. This alternative shows a ratchet mechanism 410 which may enable one-way activation and/or prevent a disconnection of the electrical connection loop. Alternative 440 illustrates the wireless communication unit 404 and power source 405 connected to the same mechanical unit 401 and the one-way activation of the electrical connection loop may be performed by the motion of the mechanical element 402 moving one or more flexible electrical insulators 411 out of the way so that the electrical connections 408 may be connected. Thus an electrical connection may be enabled between the wireless communication unit 404 and the power source 405. This alternative shows a one way motion mechanism of the insulator 411 which may enable the one-way activation and/or prevent a disconnection of the electrical connection loop since the flexible insulator may only be pulled from the connected edge, not pushed.

Optionally, the latch and/or brake are applied using a ratchet allowing only one way motion of the power source connected mechanical element.

Optionally, the latch and/or brake are applied using an electronic component that preserves power to the wireless communication unit. For example, a mechanical relay is used to close a permanent electrical connection between the power source and the wireless communication unit. For example, a field effect transistor is used to close a permanent electrical connection between the power source and the wireless communication unit.

Optionally, the latch and/or brake are applied by the ability of the mechanical element to move the electronic contacts. For example, the power source and wireless communication unit are in fixed positions and the mechanical element is capable of moving electrical contacts only in one direction to close the electronic power loop.

Optionally, the latch and/or brake are applied by the ability of the mechanical element to move the power source. For example, the wireless communication unit is in a fixed position and the mechanical element is capable of moving the power source only in one direction to close the electronic power loop.

Optionally, the latch and/or brake are applied by the ability of the mechanical element to move the wireless communication unit. For example, the power source is in a fixed position and the mechanical element is capable of moving the wireless communication unit only in one direction to close the electronic power loop.

Optionally, the latch and/or brake are applied by the ability of the mechanical element to move both the wireless communication unit and the power source.

Optionally, the latch and/or brake are applied by the single pulling force breaking part of the mechanical elements so that it may not disconnect the power supply from the wireless communication unit.

Optionally, the latch and/or brake are applied by the mechanical elements removing an insulator between electrical connections of the power supply and the wireless communication unit.

Optionally, the latch and/or brake are applied by the mechanical elements chemically activating the power supply which is permanently connected to the wireless communication unit. For example a zinc-air battery is used as a power source and the mechanical element punctures the air seal. For example, the mechanical element spills an electrolyte liquid between the anode and the cathode of a battery. For example, the mechanical element moves the anode and the cathode of a battery into contact with an electrolyte liquid.

Optionally, distress signal trigger devices require a minimum pulling force to activate. For example, the device requires a pulling force of 2 Newton to activate to avoid false alarms. For example, the minimum pulling force is enabled by an elastic portion of the mechanical element. For example, the minimum pulling force is enabled by an elastic element attached to the mechanical element. For example, the minimum pulling force is enabled by friction of the mechanical element when a pulling force is applied.

Optionally, the power source is not connected to the wireless communication unit prior to a distress event. For example, the distress signal trigger devices features zero power consumption prior to activation for long shelf life by storing a disconnected power source that is only connected upon activation. For example, the power source is a zinc-air battery and only activated when the seal is punctured.

Optionally, the power source is permanently connected to the wireless communication unit and activated electronically and/or a using general digital input of a microprocessor.

Optionally, the power source is a primary type battery. For example, the power source is a primary Li chemistry battery and/or a primary alkaline battery.

Optionally, the power source is a rechargeable type battery. For example, the power source is a primary Li-ion chemistry battery and/or a Nickel metal hydride battery.

Optionally, the power source is an electronic component. For example, the power source is capacitor and/or supercapacitor and charged by USB during configuration.

Figure 5:
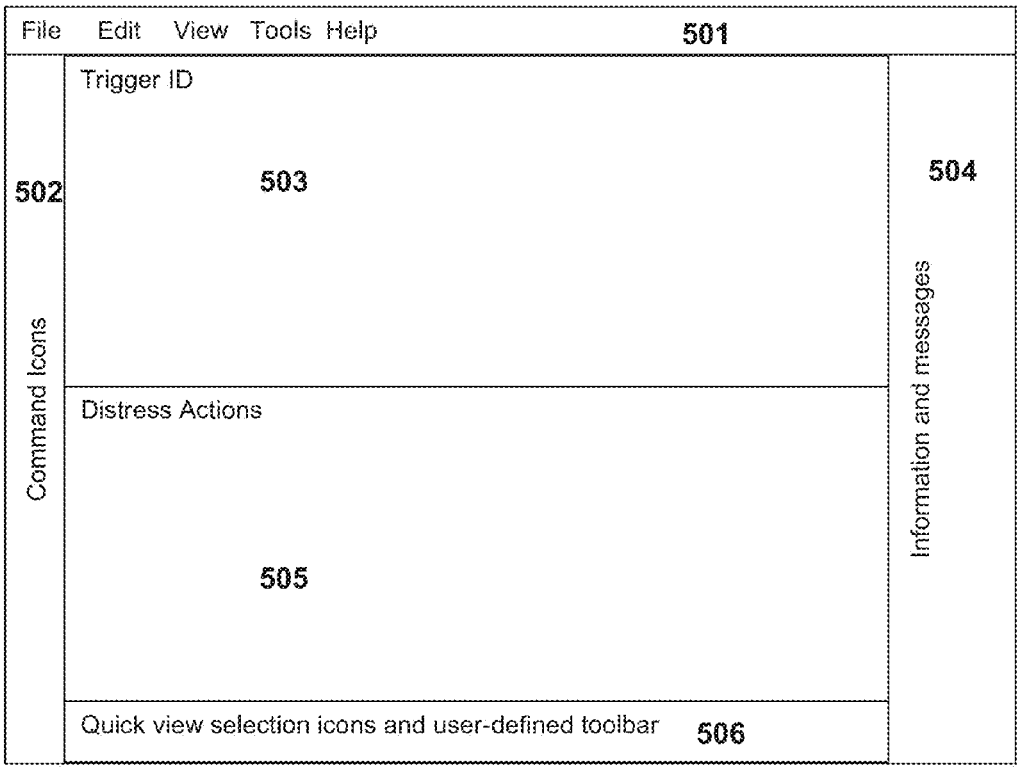
FIG. 5 is a schematic illustration of a user interface for configuring and activating a distress signal trigger devices, according to some embodiments of the invention.

Optionally, distress signal trigger devices are configured using a user interface on a personal computer application, using web page, or remotely using a cloud server. Reference is now made to FIG. 5, which is a schematic illustration of a user interface for configuring and activating a distress signal trigger devices, according to some embodiments of the invention. The user interface may contain a menu area 501, a command icon area 502, a trigger ID area 503, a distress action configuration editor area 505, an information/message area 504 and a quick view/selection area 506. The user interface may also contain a user defined menus area 506.

The flowchart and block diagrams in the Figures illustrate the architecture, functionality, and operation of possible implementations of systems, methods and devices according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant wireless communication methods, devices and interfaces may be developed and the scope of the term transferring a distress signal is intended to include all such new technologies a priori.

It is expected that during the life of a patent maturing from this application many relevant mobile power sources may be developed and the scope of the term power source is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A device for initiating a distress signal to a mobile communication device, comprising:

a first mechanical element;

a power source;

a second mechanical element for receiving a pulling force when a distress event occurs, such that said pulling force causes a motion of said second mechanical element relative to said first mechanical element, said second mechanical element motion connects a constant electrical loop between said power source and a wireless communication unit, and said second mechanical element is capable of moving in only one direction any from a list of said power source, an electrical circuit, a power source activator, and at least one electrical connection between said power source and said electrical circuit, thereby preventing a disconnection of said electrical loop;

said wireless communication unit comprising a processing unit and a non-volatile memory value of a device identification code; and a communication interface for transferring from said wireless communication unit a distress signal to a mobile communication device, said distress signal comprising said device identification code;

wherein said power source activator is any from a list of a zinc-air battery seal puncture, a battery electrolyte dispenser, a battery anode mover, and a battery cathode mover, enabling said pulling force to trigger a supply of power from said power source to said wireless communication unit.

2. The device of claim 1, wherein said power source is in a fixed position relative to said first mechanical element and said wireless communication unit is in a fixed position relative to said second mechanical element.

3. The device of claim 1, wherein said mobile communication device is any from a list of cellular phone, smart phone, computing tablet, music player, smart watch, personal computer, Bluetooth headset, automobile speakerphone, Bluetooth speaker system, and automobile central processing unit.

4. The device of claim 1, wherein said device further comprises an inhibiting brake to prevent a disconnection of said constant electrical loop, said inhibiting brake is any from a list of ratchet, latch, and breakable portion of said second mechanical element.

5. The device of claim 1, wherein said constant electrical loop between a power source and a wireless communication unit is connected by motion of any component from a list of power source, wireless communication unit, both power source and wireless communication unit, and one or more electrical contact between power source and mobile wireless communication unit.

6. The device of claim 1, wherein said power source is connected to said wireless communication unit after a distress event occurs.

7. The device of claim 1, wherein said communication interface is any interface from a list of Bluetooth, wireless local area network, personal local area network, body area network, near field communication, and proximity marketing interfaces.

8. The device of claim 1, wherein said device further comprises any executable application from a list of mobile communication device, personal computer, web page, and cloud server based executable applications, used to configure said device.

9. The device of claim 1, wherein said power source activator is a moveable electrical insulator preventing any of said at least one electrical connection from supplying power from said power supply to said wireless communication unit until a physical force removes said moveable electrical insulator.

10. A device for initiating a distress signal to a mobile communication device, comprising:

a first mechanical element;

a second mechanical element for receiving a pulling force when a distress event occurs, such that said pulling force causes a motion of said second mechanical element relative to said first mechanical element, said second mechanical element motion connects a constant electrical loop between a power source and a wireless communication unit, and said second mechanical element is capable of moving in only one direction any from a list of said power source, an electrical circuit, a power source activator, and at least one electrical connection between said power source and said electrical circuit, thereby preventing a disconnection of said electrical loop;

said power source;

said wireless communication unit comprising a processing unit and a non-volatile memory value of a device identification codes; and a communication interface for transferring from said wireless communication unit a distress signal to a mobile communication device, said distress signal comprising said device identification code;

wherein said disconnection of said electrical loop is prevented by an electronic component from a list of electromechanical relay and field effect transistor which preserve a power connection to said wireless communication unit.

11. The device of claim 10, wherein said device is a wearable device located on an item of clothing of a user in distress, and said pulling force is activated by a violation of said clothing.

12. The device of claim 11, wherein said device is a wearable device located on an ornament of a user in distress, and said pulling force is activated by a violation of said ornament.

* * * * *